United States Patent [19]

Marshall

[11] Patent Number: 5,018,340

[45] Date of Patent: May 28, 1991

[54] SPORTS SADDLE

[76] Inventor: Robert L. Marshall, Rt 2, Box 306B, Salem, Ky. 42078

[21] Appl. No.: 336,920

[22] Filed: Apr. 12, 1989

[51] Int. Cl.[5] ..... B68C 1/02
[52] U.S. Cl. ..... 54/44; 54/66
[58] Field of Search ..... 54/44, 46, 65, 66

[56] References Cited

U.S. PATENT DOCUMENTS

| | | | |
|---|---|---|---|
| 57,214 | 8/1866 | Stockton et al. | 54/46 X |
| 3,872,653 | 3/1975 | Thompson | 54/44 |
| 3,978,644 | 9/1976 | Hillman | 54/44 |
| 4,683,709 | 8/1987 | Vasko et al. | 54/66 |

FOREIGN PATENT DOCUMENTS

| | | | |
|---|---|---|---|
| 378365 | 8/1932 | United Kingdom | 54/66 |

*Primary Examiner*—Robert P. Swiatek
*Attorney, Agent, or Firm*—Warren D. Flackbert

[57] ABSTRACT

A sports saddle which eliminates the usage of heavy wooden bars extending between the forks and the cantle of the saddle trees through the use of a lightweight underlayment, thereby providing flexibility and balance for the rider. The arrangement includes nylon straps, stitched onto the underlayment and secured to the forks and cantle, which serve as stirrup and girth straps. The sports saddle of the invention is light in weight, affords better contact with the body of the horse, representing manufacturing/assembly advantages and, importantly, permits the "floating" of the saddle trees.

6 Claims, 1 Drawing Sheet

SPORTS SADDLE

As is known, the popularity of horseback riding, such as trail riding, is widespread. The saddlery employed in this connection typically utilizes saddle trees including forks, in front of the rider, a cantle, for receiving and/or positioning the rider, and a heavy left bar and a heavy right bar longitudinally disposed and spaced apart from each other, but extending along the horse between the forks and the cantle. The conventional arrangement further includes the usage of a horse blanket or like protective member between the saddle trees and the flesh of the horse.

BACKGROUND OF THE INVENTION

The sports saddle presented by the invention overcomes the need for the aforesaid heavy left and right bars, where, instead, a lightweight skin clinging underlayment, as in the form of foam or neoprene rubber, serves to position the two-part saddle trees, i.e. the forks and the cantle, where such saddle trees "float," i.e. are secured to stirrup and girth straps stitched onto the underlayment. The predominant feature of the invention is the aforesaid absence of the presently known heavy bars. Moreover, and with the usage of the lightweight underlayment, desirable flexibility and balance is afforded the rider.

In any event, a better understanding of the present invention will become more apparent from the following description, taken in conjunction with the accompanying drawing, wherein

Figure 1:
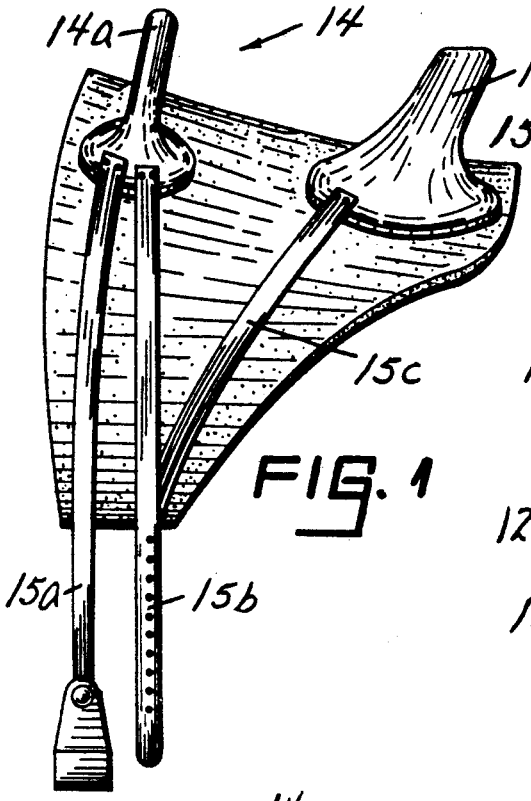
FIG. 1 is a view in side elevation of a sports saddle in accordance with the teachings of the present invention.
Figure 2:
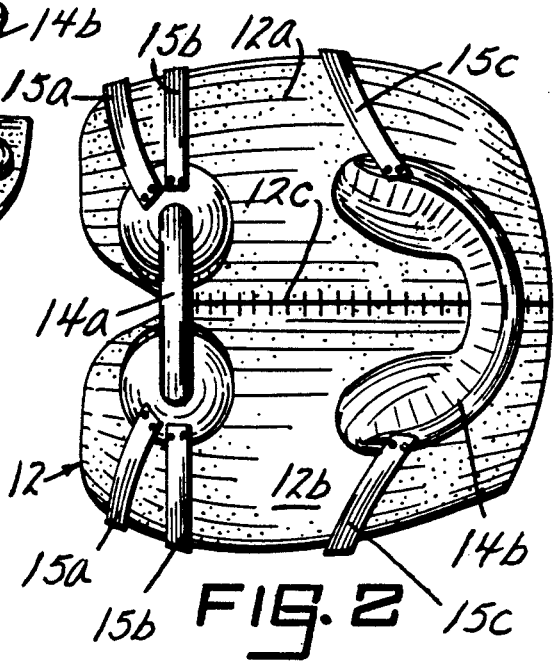
FIG. 2 is a top plan view of the invention, looking downwardly on FIG. 1.
Figure 3:
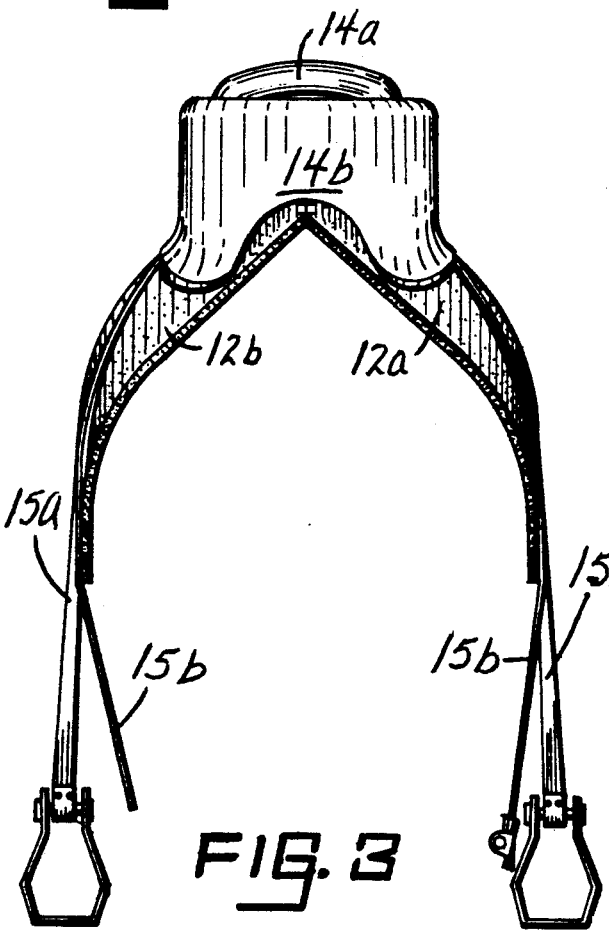
FIG. 3 is a view in rear elevation of the instant sports saddle, looking from right to left in FIG. 2; and, FIG. 4 is a view in front elevation, looking from left to right in FIG. 2, further detailing the invention.
Figure 4:
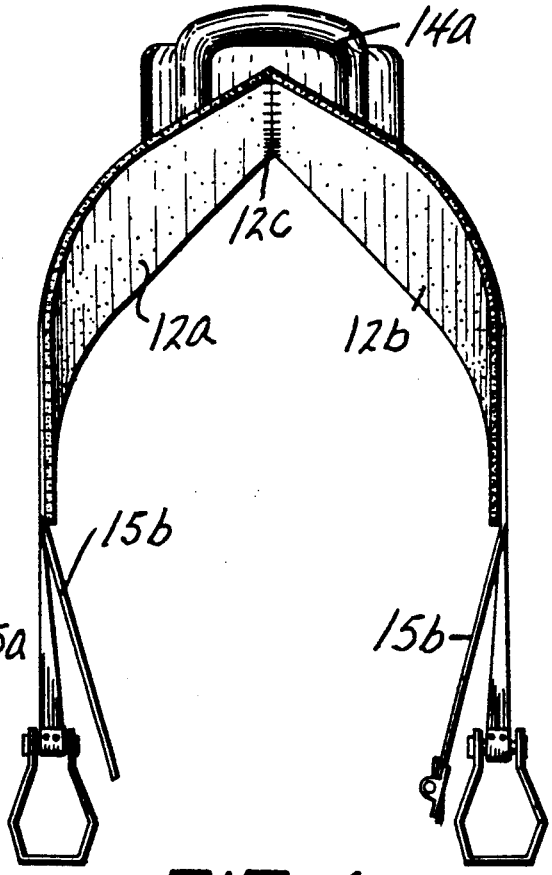

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, the sports saddle of the invention basically comprises an underlayment 12, typically defined by two parts **12*a*, 12*b* stitched together, at 12*c*, along a longitudinal midline, where such underlayment 12 is preferably made from a lightweight flexible material, such as neoprene rubber, or foam, or felt, either covered or uncovered. The material choice in connection with the underlayment 12 plays importance in the practice of the invention, since such underlayment 12** should be susceptible to changes accommodating the shape of the horse's body.

Saddle trees 14, in the form of forks **14*a*, are disposed on the forward region, i.e. toward the horse's head, of the underlayment 12, and in the form of a cantle 14*b*, at the rear region of the underlayment 12. In any event, each of the trees 14*a*, 14*b*** is generally light in weight, and formed from, for example, fiberglass covered wood, a molded plastic resin, or the like.

The trees 14 are typically maintained on the underlayment 12 by straps **15*a*, 15*b*, 15*c*, as nylon webbing, stitched thereto, each of which connects to the trees 14** by finishing screws and washers (not detailed). In other words, the saddle trees "float", providing an optimum degree of comfort to the rider.

The preceding are generally identified as stirrup straps **15*a* complemented with girth straps 15*b*, 15*c*, each originating on opposite sides of the saddle trees 14*a*, 14*b* and joined together (15*b*, 15*c*) at the mid-regions of the sides of the horse. In other words, strap 15*b* may extend continuously from each side of saddle tree 14*a*, whereas each strap 15*c* extends from the saddle tree 14*b* to the aforementioned mid-region. Provision is then made for securement of the free ends of the girth straps 15*b*, 15*c*** beneath the body of the horse.

In other words, and from the preceding, it should be evident that the sports saddle presented herein represents ease in placement and, as stated, both flexibility and balance for the rider. Only a thin amount of underlayment 12 is exposed to the horses body, where the saddle trees **14*a*, 14*b* "float" during a use condition. The overall sports saddle is maintained on the horse through the aforementioned encircling girth straps 15*b*, 15*c***.

In any event, the keynote of the invention is the simplicity of assembly and in components, i.e. the elimination of the prior used heavy bars, and the further elimination of a centrally positioned front saddle tree.

The sports saddle described hereabove is susceptible to various changes within the spirit of the invention, including, by way of example, in proportioning; the precise material selected for the underlayment and/or the needed straps; the particular type of girth strap fastening; and, the like. Thus, the preceding description should be considered illustrative and not as limiting the scope of the following claims:

I claim:

1. A horse saddle comprising an underlayment adapted to engage the body of a horse, independent saddle trees overlaying said underlayment, and stirrup and girth straps each having a portion secured to said underlayment and a free end directly secured to a saddle tree, whereby said saddle trees freely and independently slide in limited areas on said underlayment.

2. The horse saddle of claim 1 where said portion on each of said girth straps is stitched to said underlayment.

3. The horse saddle of claim 1 where said underlayment is represented by two parts secured together longitudinally with respect to the body of the horse.

4. The horse saddle of claim 1 where said underlayment is light in weight and flexible.

5. The horse saddle of claim 1 where said underlayment is a foam material.

6. The horse saddle of claim 1 where said underlayment is neoprene rubber.

* * * * *